US009044113B2

(12) United States Patent
Hargett

(10) Patent No.: US 9,044,113 B2
(45) Date of Patent: Jun. 2, 2015

(54) CONTAINER JACKET FOR A BEVERAGE GLASS

(76) Inventor: William Gabriel Hargett, Asheville, NC (US)

( * ) Notice: Subject to any disclaimer, the term of this patent is extended or adjusted under 35 U.S.C. 154(b) by 156 days.

(21) Appl. No.: 13/106,939

(22) Filed: May 13, 2011

(65) Prior Publication Data

US 2012/0285973 A1 Nov. 15, 2012

(51) Int. Cl.
*A47G 23/02* (2006.01)
*B65D 81/38* (2006.01)

(52) U.S. Cl.
CPC ..... *A47G 23/0216* (2013.01); *B65D 81/3876* (2013.01)

(58) Field of Classification Search
CPC ..... A47G 23/0216; B65D 81/3876
USPC ..... 220/737, 738, 739, 740, 694, 697, 722, 220/735; 215/390; 206/217, 218
See application file for complete search history.

(56) References Cited

U.S. PATENT DOCUMENTS 4,907,350 A * 3/1990 Chilewich et al. ..... 36/19 R
4,927,014 A * 5/1990 Pulichino, Jr. ..... 206/287.1
6,059,140 A * 5/2000 Hicks ..... 220/739
7,228,987 B2 * 6/2007 Jones ..... 220/739
D589,758 S * 4/2009 Mancha et al. ..... D7/624.2
D590,211 S * 4/2009 Mancha et al. ..... D7/624.2
8,002,143 B2 * 8/2011 Vorderkunz ..... 220/739
2008/0017654 A1 * 1/2008 Chu ..... 220/739
2008/0116342 A1 * 5/2008 Oliver ..... 248/311.2
2011/0114647 A1 * 5/2011 Hallberg ..... 220/592.17

* cited by examiner

*Primary Examiner* — Robert J Hicks
*Assistant Examiner* — Kareen Rush
(74) *Attorney, Agent, or Firm* — The Van Winkle Law Firm; David M. Carter

(57) ABSTRACT

A container jacket is provided having a perimeter portion, the perimeter portion having a first lateral edge, a second lateral edge, a plurality of eyelets formed adjacent the first lateral edge, and a second plurality of eyelets formed adjacent the second lateral edge, the perimeter portion forming an interior volume for receipt of a container therein in a deployed condition of the container jacket, and an interconnecting element. The interconnecting element extends to and between the first plurality of eyelets and the second plurality of eyelets, the interconnecting element being operable to maintain the first lateral edge and the second lateral edge within a predetermined spacing of one another.

8 Claims, 12 Drawing Sheets

CONTAINER JACKET FOR A BEVERAGE GLASS

BACKGROUND OF THE INVENTION

Drinking glasses have long been used for the consumption of alcoholic beverages such as draft beer as well as non-alcoholic beverages such as soda or iced tea. While a drinking glass itself provides some beneficial insulative properties to retain cold beverages at their cooler temperatures, condensation typically forms on the outside of the drinking glass, thereby wetting the hand of the beverage consumer as the drinking glass is continuously or periodically held during the consumption process. One common solution to this problem is to take a napkin and wrap the napkin around the container to absorb the condensation. Generally this is only a temporary solution since the condensation wicks from the surface of the napkin touching the container to the surface of the napkin touching the hand of the consumer, plus the napkin has a tendency to lose structural integrity under these conditions. If the cold beverage is in a can, one known approach is to provide an insulated device to hold the beverage container, e.g. a koozie or a coozie. These container holders are generally made from closed or open cell foam materials and are designed to be sturdy and to have insulating properties. These container holders often have logos or promotional information displayed on the outside since both the manufacturers of cold beverages and the owners of establishments serving cold beverages use this medium to advertise their respective brands. Historically, beverage manufacturers have been producing for promotional distribution paper drink coasters and bar napkins with their advertising logos/messages on them and these are often distributed free of charge to restaurants and bars.

While beverage holders made of a flexible insulating materials (such as neoprene) exist for cylindrical beverage containers (such as soda cans), there is a need for a container jacket for frusto-conical containers such as commonly used pint drinking glasses that not only minimizes the unpleasant effects of condensation on the outside of the drinking glass but is also convenient to carry and deploy. Moreover, it would be desirable if such a container jacket is capable of holding containers of various shapes and sizes and is able to be disposed in a space-saving non-deployed carry disposition when not holding a container.

SUMMARY OF THE INVENTION

According to one aspect of the present invention, there is provided a container jacket having a perimeter portion, the perimeter portion having a first lateral edge, a second lateral edge, a plurality of eyelets formed adjacent the first lateral edge, and a second plurality of eyelets formed adjacent the second lateral edge, the perimeter portion forming an interior volume for receipt of a container therein in a deployed condition of the container jacket, and an interconnecting element. The interconnecting element extends to and between the first plurality of eyelets and the second plurality of eyelets, the interconnecting element being operable to maintain the first lateral edge and the second lateral edge within a predetermined spacing of one another.

The container jacket can be provided with a perimeter portion is formed of a leather material. Additionally, the perimeter portion is movable between a deployed condition in which the perimeter portion forms a semi-arcuate shape and a non-deployed condition in which the perimeter portion delimits an annular interior volume. In accordance with one feature of the one aspect of the present invention, the interconnecting element is a continuous strand of a cord material.

According to another aspect of the present invention, there is provided a container jacket having a pair of perimeter portions, each perimeter portion having a first lateral edge, a second lateral edge, a plurality of eyelets formed adjacent the first lateral edge, and a second plurality of eyelets formed adjacent the second lateral edge, the perimeter portions forming an Interior volume for receipt of a container therein in a deployed condition of the container jacket, and an interconnecting element. The interconnecting element extends to and between the first plurality of eyelets and the second plurality of eyelets of the pair of perimeter portions, the interconnecting element being operable to maintain the first lateral edge of a respective perimeter portion and the second lateral edge of the other perimeter portion within a predetermined spacing of one another and to maintain the second lateral edge of the respective perimeter portion and the first lateral edge of the other perimeter portion within a predetermined spacing of one another.

DETAILED DESCRIPTION OF AN EMBODIMENT

Figure 1:
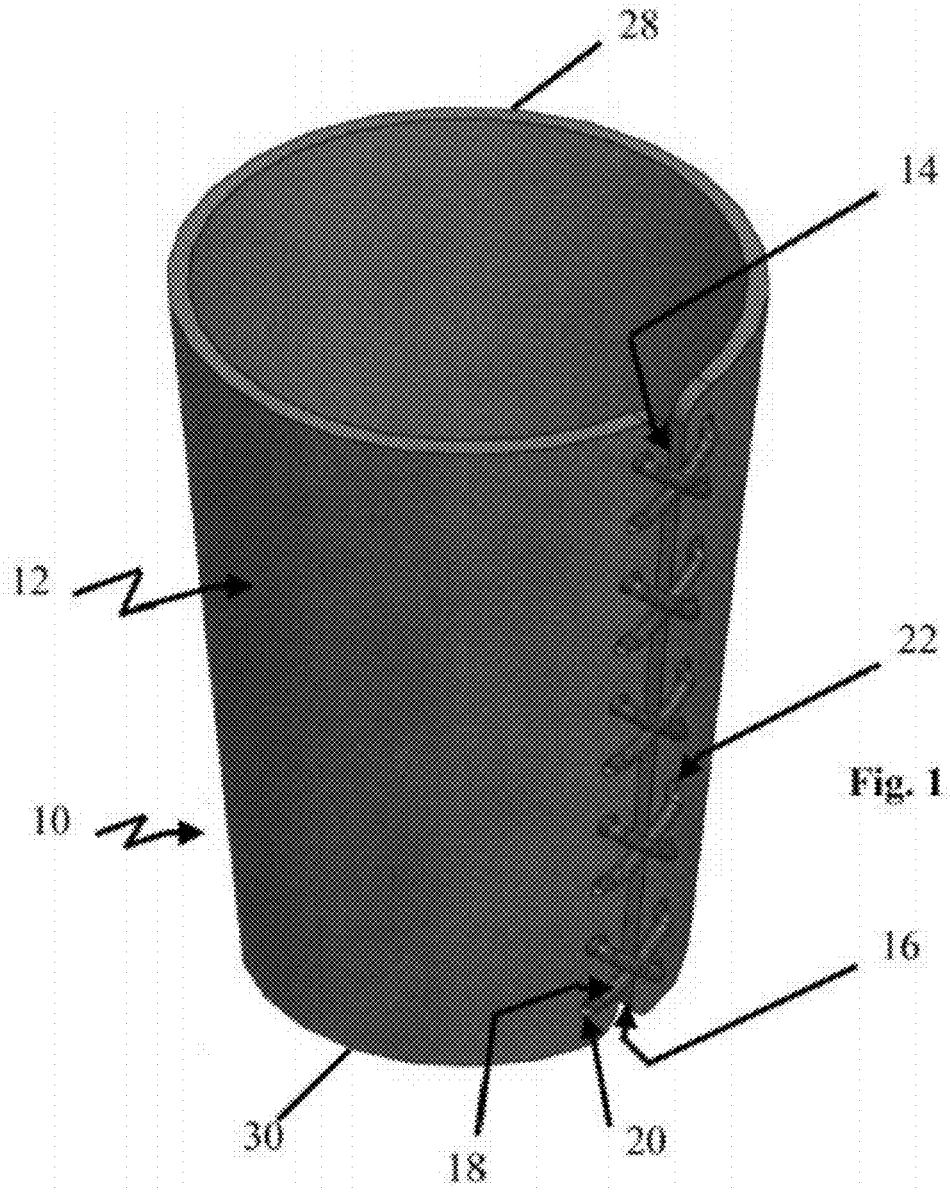
FIG. 1 is a top perspective view of the single blank container jacket of the present invention.

With reference now to FIGS. 1-8 of the present application, a single blank container jacket embodiment of the container jacket of the present invention will now be described. The container jacket, hereinafter generally designated as the container jacket 10, is operable to accommodate a container in a releasably securable condition such that the container is reliably secured in surrounding relationship by the container jacket as a beverage in the container is consumed and such that the container can be readily removed from the container jacket when empty. The beverage container received by the container jacket 10 can be in the form, for example, of an aluminum can, a drinking glass, or a bottle, such that a user can comfortably and conveniently hold the container jacket 10 and the accommodated container as a single unit while drinking from the container, disposing the container on, for example, a table or other support surface or tipping the container to discharge the beverage or other liquid retained in the container. As seen in FIG. 1, the container jacket 10 is comprised of a blank 12 which, in the container receipt condition of the container jacket shown in FIG. 1, forms a perimeter portion of the container jacket that delimits an interior volume in which a container is accommodated. The blank 12 has a first lateral edge 14 and a second lateral edge 16 and the lateral edges 14, 16 are secured in a closely adjacent relationship to one another in the container receipt condition of the container jacket 10 via an edge restraint system in the form of a continuous lace 18 threaded through a plurality of eyelets 20 located adjacent the first lateral edge 14 and a second plurality of eyelets 22 located adjacent the second lateral edge 16.

Figure 2:
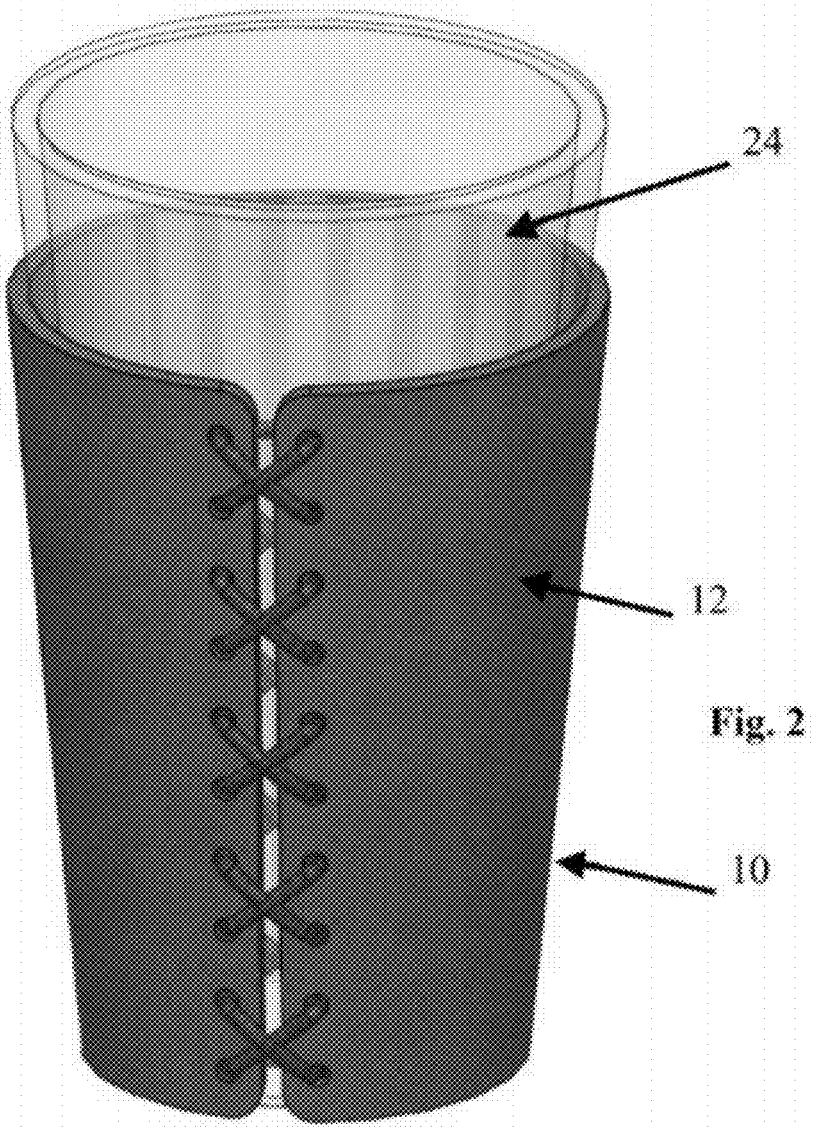
FIG. 2 is a front perspective view of the single blank container jacket shown in FIG. 1 and showing the jacket having a glass container positioned therein.
Figure 3:
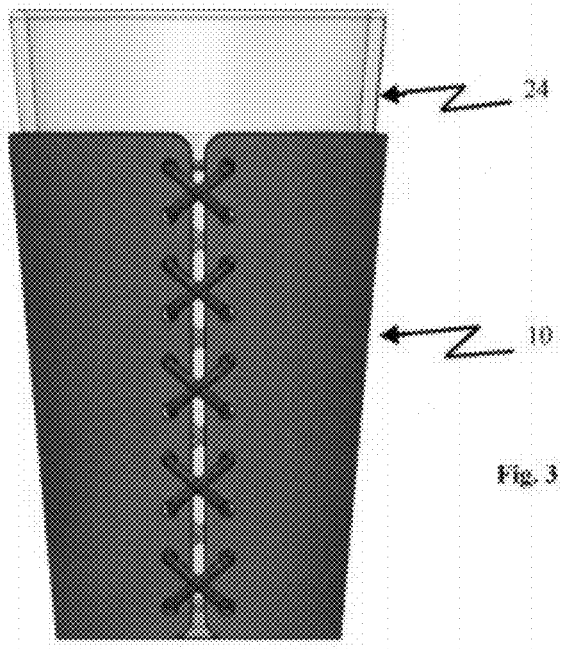
FIG. 3 is a front elevational view of the single blank container jacket and the glass container shown in FIG. 2.
Figure 5:
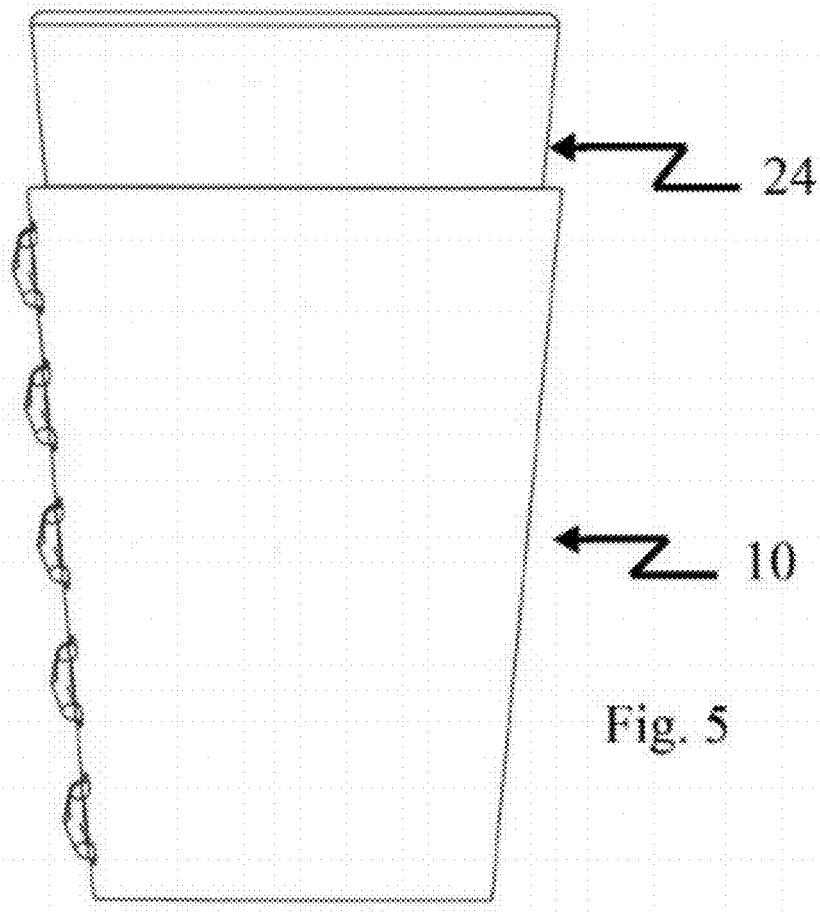
FIG. 5 is a side elevational view of the single blank container jacket and the glass container shown in FIG. 2.
Figure 6:
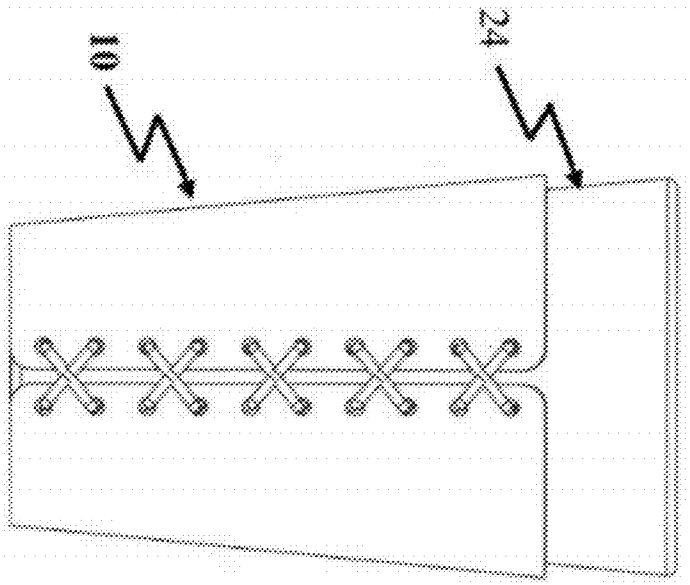
FIG. 6 is a front elevational view of the single blank container jacket and the glass container shown in FIG. 2.
Figure 7:
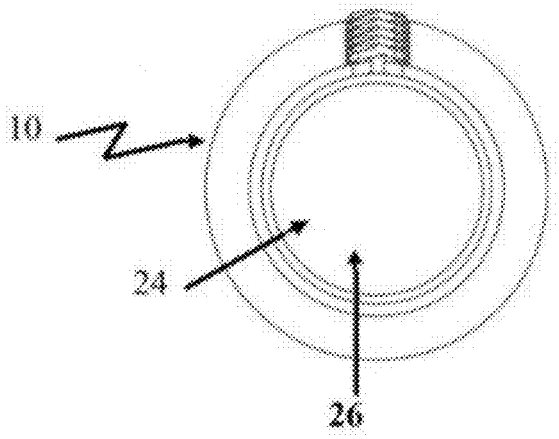
FIG. 7 is a bottom plan view of the single blank container jacket and the glass container shown in FIG. 2.
Figure 8:
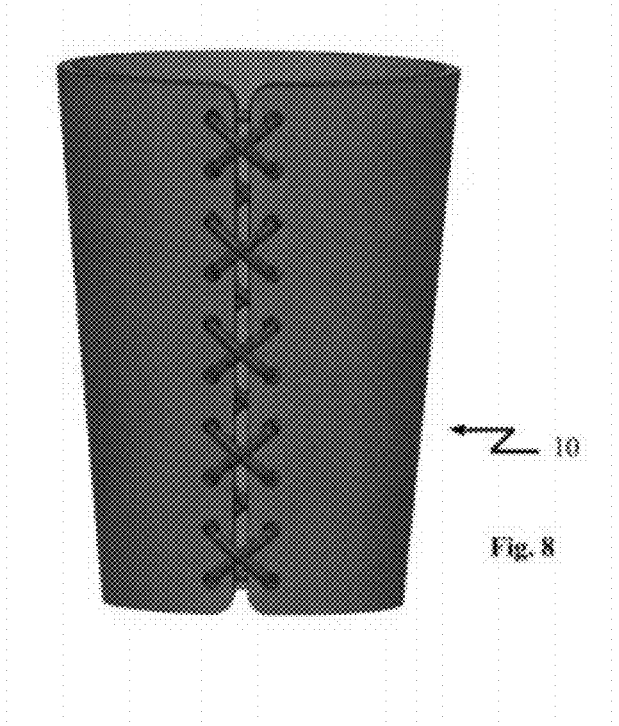
FIG. 8 is a perspective view of the single blank container jacket shown in FIG. 1.

As seen in FIG. 2, in its container receipt condition, the container jacket 10 accommodates a container such as a container in the form of an eight ounce drinking glass 24, which is representatively shown as a container in FIG. 2. The blank 12 of the container jacket 10 is preferably configured such that the interior surface of the blank 12 that delimits the interior volume of the container jacket is compatibly configured with respect to the outer surface of the container received in the interior volume—in this case, the outer surface of the drinking glass 24. Accordingly, if the drinking glass 24 is formed of a frusto-conical overall shape (an overall shape of a truncated cone), then the interior surface of the blank 12 of the container jacket 10 is preferably configured with a compatibly dimensioned frusto-conical configuration. FIG. 5 shows a side view of the drinking glass 24 received in the interior volume of the container jacket 10, FIG. 6 shows a front view of the glass container 24 received within the interior volume of the container jacket 10, and FIG. 7 shows a bottom view of the flat planar bottom of the drinking glass 24, designated as the drinking glass bottom 26, and the container jacket 10. FIG. 8 is a perspective view of the container jacket 10 in its container receipt position and showing the container jacket without a container being received by the container jacket. FIG. 3 is a front view of the container jacket 10 having the drinking glass 24 received therein. The container jacket 10 can be configured to a variety of containers including frusto-conically shaped containers such as a 12 ounce (355 ml) frusto-conical glass or a 16 ounce (473 ml) frusto-conical glass or cylindrical containers such as a 12 ounce (355 ml) aluminum can or a 16 ounce (473 ml) plastic bottle.

Figure 4:
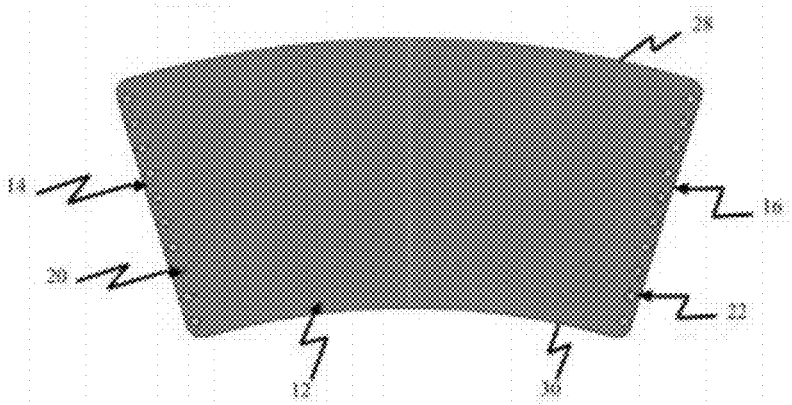
FIG. 4 is a top plan view of the blank of the single blank container jacket shown in FIG. 1.

As seen in FIG. 4, the blank 12 of the container jacket 10 has an overall arcuate lengthwise shape when disposed in a flat planar condition in which the first lateral edge 14 delimits one lateral side of the flat planar blank 12 and the other lateral edge 16 delimits an opposite lateral side of the flat planar blank 12. A top edge 28 of the blank 12 delimits an arc defined by a predetermined radius and a bottom edge 30 of the blank 12 delimits an arc of a lesser radius than the predetermined radius of the top edge 28 with both radii measured from the same center point (not shown). The first plurality of eyelets 20 formed adjacent the first lateral edge 14 of the blank 12 are disposed at serial uniform spacings from one another along a line extending parallel to the first lateral edge 14 from the top edge 28 to the bottom edge 30 of the blank 12. The second plurality of eyelets 22 closely adjacent the second lateral edge 16 of the blank 12 are disposed at serial uniform spacings from one another along a line extending from the top edge 28 to the bottom edge 30 of the blank 12.

To dispose the container jacket 10 in its container receipt position, the blank 12 is moved from its flat planar condition as shown in FIG. 4 into a disposition in which the first lateral edge 14 of the blank 12 is relatively close and adjacent to, and generally parallel to, the second lateral edge 16 of the blank. Thereafter, the lacing 18, which may be in the form, for example, of a cord of natural or synthetic material such as, for example, a cord formed of leather material, is interlaced in any suitable manner between the first plurality of eyelets 20 and the second plurality of eyelets 22. The interlacing pattern shown in FIGS. 1-8 of the container jacket 10 is an interlacing pattern in which the lacing 18 runs from a respective one of the first plurality of eyelets 20 to a respective one of the second plurality of eyelets 22 that is offset from the respective first eyelet in a vertical direction. The free ends of the lacing 18 (not shown) may be terminated in any suitable manner such as, for example, via a knot, fusing of the two free ends to one another, or any other suitable cord end retaining manner.

The blank 12 is preferably formed of a material that facilitates convenient and secure grasping of the container jacket 10 when a container such as the drinking glass 24 is received in the container jacket 10. The material of the blank 10 may be an insulating material or a non-insulating material and, in the event that the blank 12 is formed of an insulating material, the insulative properties of the material may be such that thermal transfer in one given direction is blocked or promoted or alternatively, such that thermal transfer in 2 opposing directions is selectively blocked and/or promoted. One example of a suitable insulative property of the blank 12 of the container jacket 10 can be understood with reference to a selection of a leather material for the blank 12. If the blank 12 is formed of a leather material and, additionally, if the drinking glass 24 retains a beverage therein having a temperature less than ambient temperature—i.e., a chilled beverage—then the leather material of the blank 12 will operate to slow or retard the heating up of the surface of the drinking glass 24 in contact with the leather material while, at the same time, acting to slow or retard the transfer of the heat of the higher temperature ambient air from the exterior of the container jacket 10 interiorly towards the drinking glass 24.

Figure 9:
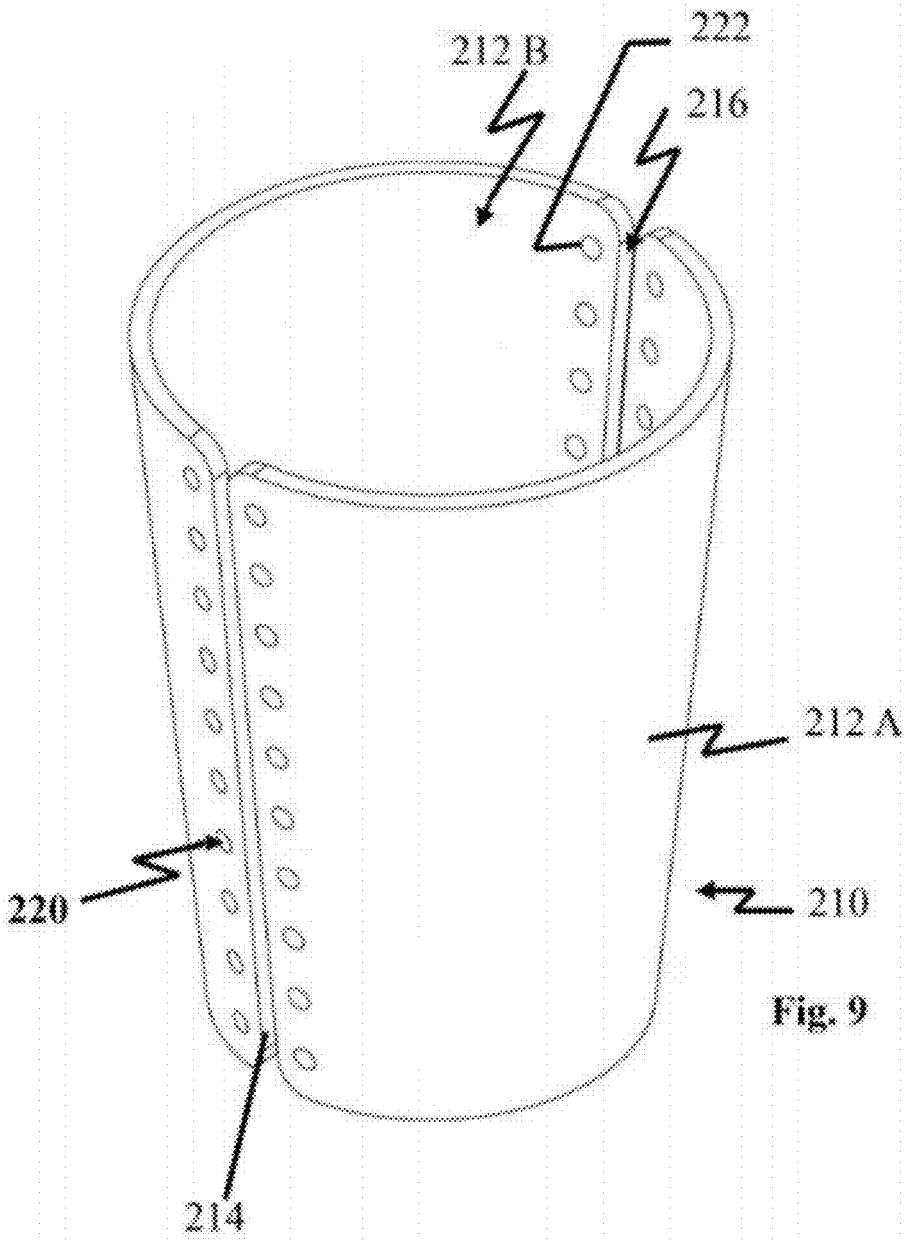
FIG. 9 is a top perspective view of a double blank container jacket of the present invention.
Figure 10:
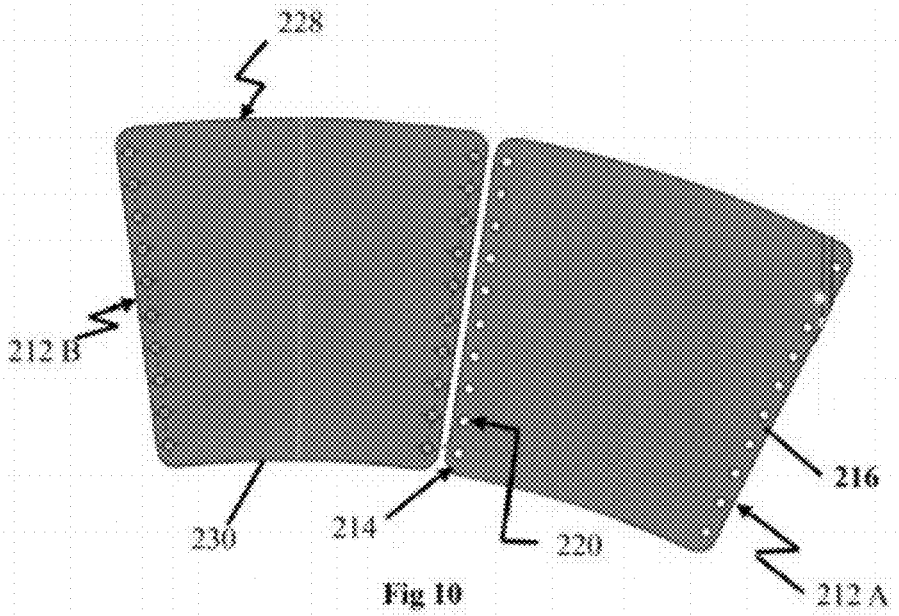
FIG. 10 a top plan view of the two blanks of the double blank container jacket shown in FIG. 9.

Reference is now had to FIGS. 9-10 for a description of a double blank container jacket version of the, container jacket of the present invention. As seen in FIG. 9, which is a top perspective view of a double blank container jacket version of the container jacket of the present invention, a container jacket 210 is formed of a pair of blanks 212A, 212B, interconnected to one another by a pair of edge securement assemblies of which only the eyelets of the edge securement assemblies are shown. The container jacket 210 shown in FIG. 9 is shown in its container receipt disposition in which the pair of blanks 212A, 212B each have a semi-arcuate shape and together delimit an interior volume for receiving a container such as, for example, the drinking glass 24. Each of the pair of blanks 212A, 212B forms a perimeter portion of the container jacket 210 and, specifically, forms slightly less than a one hundred and eighty degree portion of the three hundred and sixty degree perimeter that the container jacket 210 delimits around a container received therein. As seen in FIG. 10, which is a top plan view of the blanks of the container jacket in their non-assembled planar dispositions, the blanks 212A, 212B each have a first lateral edge 214 and a second lateral edge 216 and a respective plurality of eyelets 220 are formed closely adjacent each respective lateral edge 214, 216. Each blank 212A, 212B includes an arcuate top edge 228 and an arcuate bottom edge 230 that is of an extent, as measured from the respective first lateral edge 214 to the second lateral edge 216 of the respective blank, less than the extent of the arcuate top edge 228.

Figure 11:
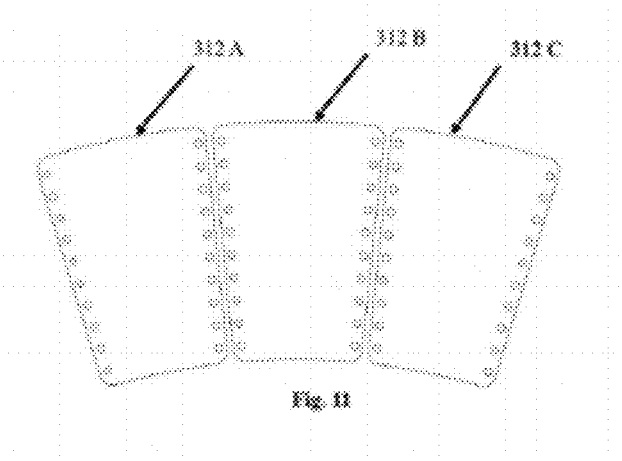
FIG. 11 is a top plan view of an alternate version of the jacket of the present invention.

To assemble the pair of blanks 212A, 212B into their respective dispositions such that the container jacket 210 is disposed in its container receipt disposition, a suitable cord such as, for example, the lacing 18 described with respect to the single blank container jacket version of the container jacket illustrated in FIGS. 1-8, is threaded through the first plurality of eyelets 220 of a respective one of the blanks and thereafter through the respective adjacent plurality of eyelets of the other blank. The same extent of the lacing 18 or, alternatively, a second extent of the lacing 18, is threaded through the other adjacent pair of eyelets of the pair of blanks 212A, 212B. The pair of blanks 212A, 212B are dimensioned with respect to one another such that, once the lacing 18 has been disposed to secure the pair of blanks to one another, the pair of blanks delimit a substantially enclosed frusto-conical interior volume in which a container may be placed. Alternatively, the present invention also contemplates that, in lieu of the pair of blanks 212A, 212B, a plurality of blanks greater than two blanks may be deployed to delimit a conical or frusto-conical interior volume in which a container can be received. As seen in FIG. 11, which is a top plan view of three blanks of such an alternate configuration, three blanks 312A, 312B, 314C that can be deployed to form a container jacket having multiple blanks, each blank is provided with two pluralities of eyelets throw which an appropriate cord material such as the lacing 18 can be threaded to interconnect the blank to respective adjacent blanks. Each of the blanks 312A, 312B, and 312C have an extent such that, when all of the blanks of the container jacket are assembled, the blanks collectively delimit a perimeter that is, at most, a 360 degree perimeter.

The present invention also contemplates that the respective blanks of a container jacket can be disposed in overlapping relationship along their lateral edges. Such a container jacket (not shown) may be comprised of two or more blanks and, for example, a respective plurality of eyelets on one blank may be disposed in overlapping registry with a respective plurality of eyelets of an adjacent blank.

Figure 12:
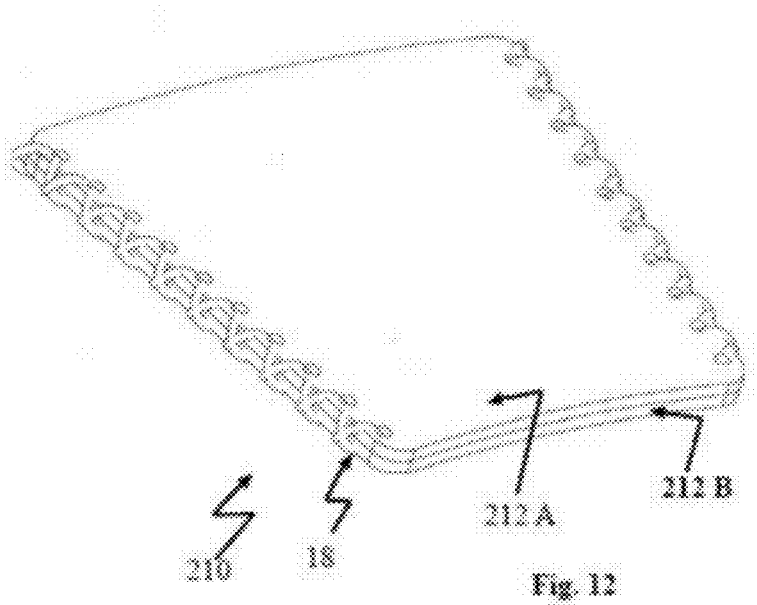
FIG. 12 is a top plan view of the jacket shown in FIGS. 9 and 10 in a non-deployed carry disposition.

References now had to FIG. 12, which is a top plan view of the container jacket 210 shown in FIGS. 9 and 10 in a non-deployed carry disposition. In this non-deployed carry disposition, the container jacket 210 is configured such that the blank 214A is "nested" or received within the semi-arcuate volume delimited by the other blank 212B. The lacing 18 is configured with a "play" or looseness sufficient to permit the blank 212A to be nested inside the space delimited by the other blank 212B. Alternatively, the lacing 18 can be configured in coordination with the material selected for the blanks 212A, 212B such that the blanks are sufficiently flexible to permit the nesting of one blank within the other. The non-deployed carry disposition of the container jacket 210 shown in FIG. 12 permits a user to comfortably and conveniently carry the container jacket 210 in, for example, a pocket of a pair of pants or in a carry bag such as a purse. Additionally, when a user desires to transform the container jacket 210 from its non-deployed carry disposition into its container receipt disposition, the user need only manipulate the "nested" blank 212A to remove the blank from its nested disposition and deploy the blank into its semi-arcuate disposition in which it cooperates with the similarly disposed other blank 212B to delimit an interior volume in which a container such as the drinking glass 24 can be disposed.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

What is claimed is:

1. A container jacket having a deployed and non-deployed condition comprising:

a pair of perimeter portions, each perimeter portion having a first lateral edge, a second lateral edge, a plurality of eyelets formed adjacent the first lateral edge, and a second plurality of eyelets formed adjacent the second lateral edge, the perimeter portions forming an interior volume for receipt of a container therein in a deployed condition of the container jacket; and an interconnecting element extending to and between the first plurality of eyelets and the second plurality of eyelets of the pair of perimeter portions, the interconnecting element being operable to maintain the first lateral edge of a respective perimeter portion and the second lateral edge of the other perimeter portion in a closely adjacent relationship with one another and to maintain the second lateral edge of the respective perimeter portion and the first lateral edge of the other perimeter portion in a closely adjacent relationship with one another; the pair of perimeter portions delimiting a frustoconical configuration when the jacket is in the deployed condition; the pair of perimeter portions being nested together when the jacket is in the non-deployed condition.

2. The container jacket of claim 1, wherein each perimeter portion is formed of a leather material.

3. The container jacket of claim 2, wherein the respective perimeter portion is movable between a deployed condition in which the perimeter portion forms a semi-arcuate shape and a non-deployed condition which the respective perimeter portion is nested within the other perimeter portion.

4. The container jacket of claim 3, wherein the interconnecting element is a continuous strand of a cord material.

5. The container jacket of claim 1, wherein the said respective perimeter portion includes at least two sub-areas, one sub-area forming the first lateral edge of the said respective perimeter portion and another sub-area forming the second lateral edge of the said respective perimeter portion and the one sub-area and the another sub-area each delimiting an area that has a periphery that is not part of the periphery of any other sub-area, and the one sub-area and the another sub-area being connected to one another via a sub-area interconnecting element.

6. The container jacket of claim 5, wherein the one sub-area and the another sub-area of the said respective perimeter portion each have a plurality of eyelets and the sub-area interconnecting element extends to and between the plurality of eyelets of the one sub-area and the plurality of eyelets of the another sub-area.

7. The container jacket of claim 6, wherein the sub-area interconnecting element is a continuous strand of a cord material.

8. The container jacket of claim 1 wherein the jacket is open at he bottom.

* * * * *